United States Patent [19]

White

[11] 4,006,446

[45] Feb. 1, 1977

[54] RAPCON-CONTROL TOWER COORDINATION SYSTEM

[75] Inventor: James K. White, Wilmington, Del.

[73] Assignee: The United States of America as represented by the Secretary of the Air Force, Washington, D.C.

[22] Filed: Jan. 8, 1976

[21] Appl. No.: 647,526

[52] U.S. Cl. ..... 340/23; 340/213.1

[51] Int. Cl.[2] ..... G08G 1/12; G08B 25/00

[58] Field of Search ..... 340/23, 213.1

[56] References Cited

UNITED STATES PATENTS

| | | | |
|---|---|---|---|
| 2,384,352 | 9/1945 | Smith | 340/23 |
| 2,515,633 | 7/1950 | Coley | 340/23 |
| 3,193,814 | 7/1965 | Koster | 340/23 |

*Primary Examiner*—Thomas B. Habecker
*Attorney, Agent, or Firm*—Joseph E. Rusz; James S. Shannon

[57] ABSTRACT

A visual communication system using color coded lights through which the RAPCON facility at an airport keeps the control tower informed as to the status of aircraft under its control. Three approach zones based on distance from the runway are defined by the colors white, amber, and green, green being closest to the runway. Keyboards are provided at the RAPCON and the control tower, each having three illuminated primary white, amber, and green keys and three illuminated secondary white, amber, and green keys, the primary keys representing the lead aircraft in their zones and the secondary keys representing a second aircraft, if any, in the zone. Upon entry of an aircraft into a zone, the RAPCON operator actuates a primary or secondary key for that zone, as appropriate, causing flashing illumination of the key. The control tower acknowledges by momentarily depressing the flashing key, which steadies its illumination. The RAPCON operator can cancel the illumination of a key, either flashing or steady, by redepressing the key. Provision is made for automatic cancellation of primary key illumination when the primary or secondary key of the next zone nearer the runway is actuated, and for automatic transfer of secondary key illumination, either steady or flashing, to the primary key when the primary is cancelled. An additional key, coded red to indicate an emergency situation for the lead green zone aircraft, can be actuated either by the RAPCON or the control tower, but cancelled only by the control tower. Actuation of the red key automatically cancels primary green and prevents further actuation of primary green, or transfer of secondary green, until red is cancelled.

6 Claims, 11 Drawing Figures

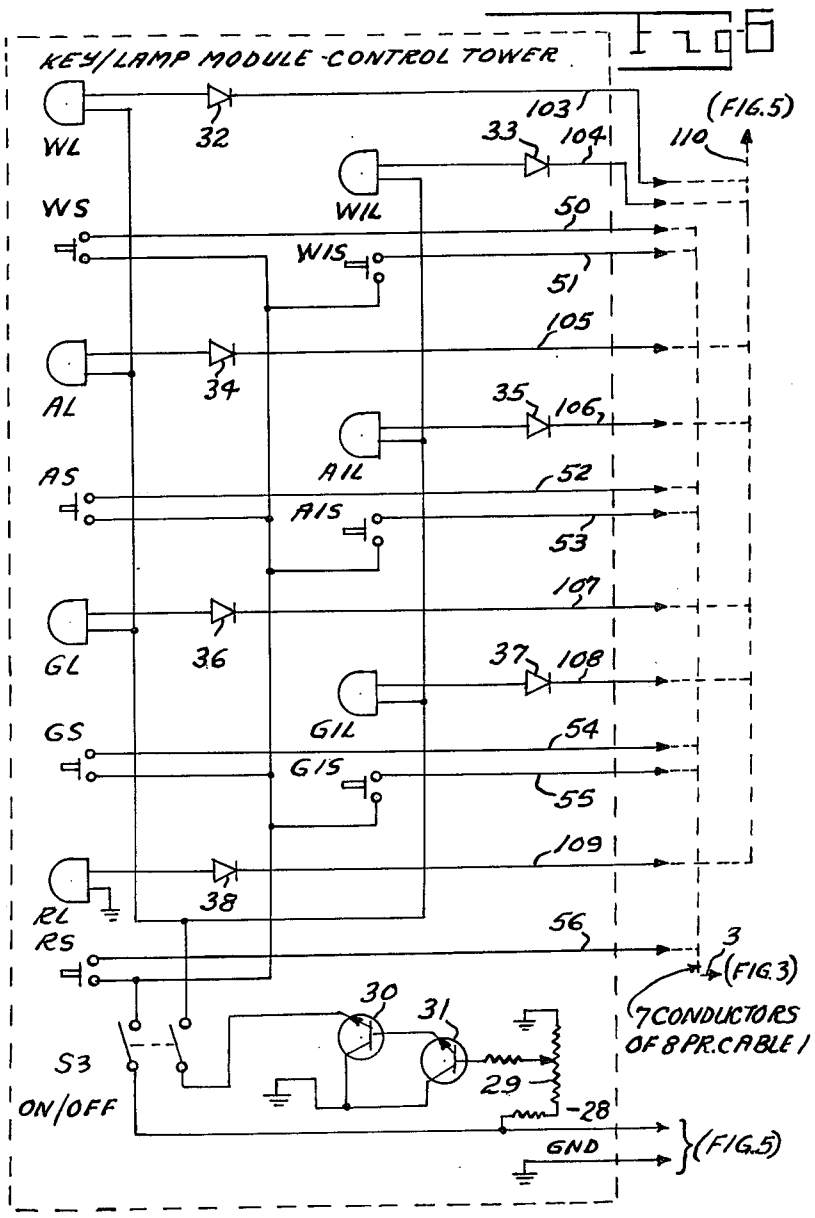
KEY/LAMP MODULE-CONTROL TOWER
(FIG.5)
110
103
104
33
50
51
105
106
35
52
53
107
108
37
54
55
109
56
3
(FIG.3)
7 CONDUCTORS OF 8 PR. CABLE 1
(FIG.5)
-28
GND
29
31
30
32
34
36
38
WL
WS
WIL
WIS
AL
AS
AIL
AIS
GL
GS
GIL
GIS
RL
RS
S3
ON/OFF
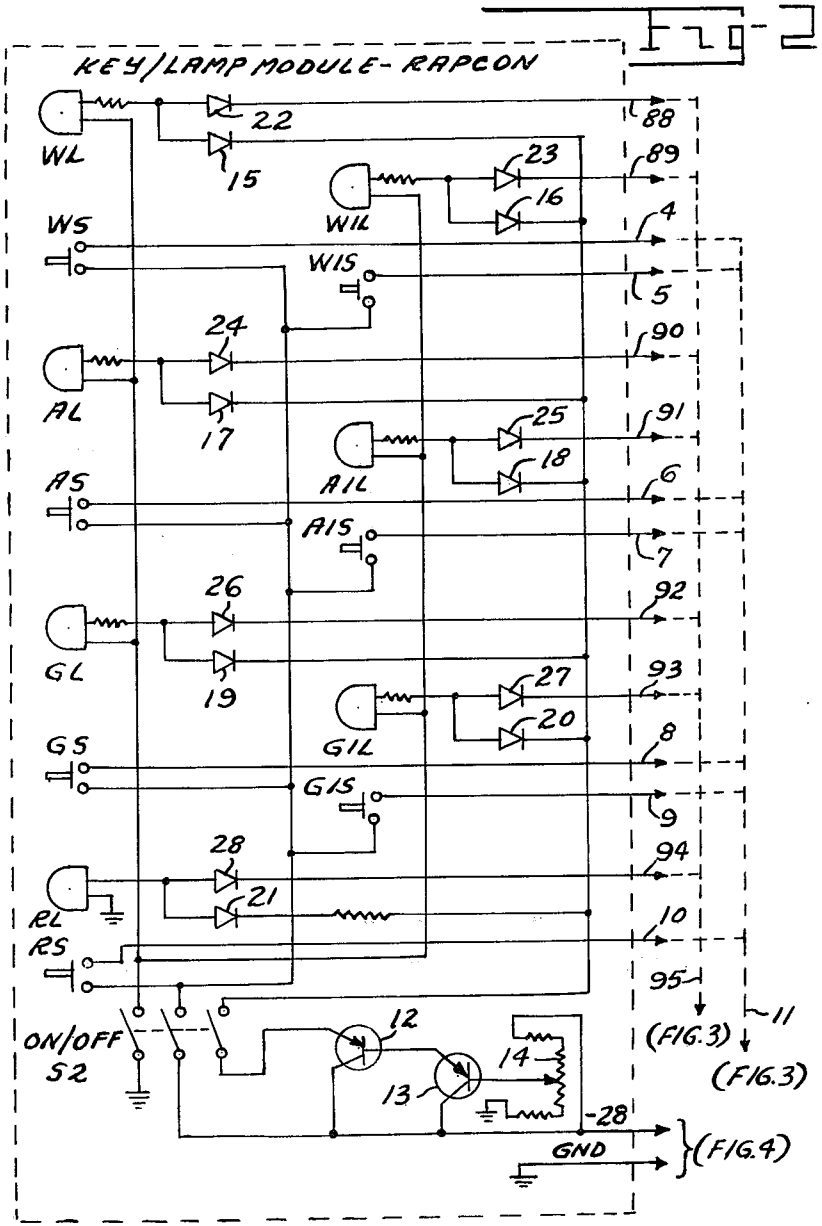
KEY/LAMP MODULE-RAPCON
88
89
4
5
90
91
6
7
92
93
8
9
94
10
95
11
(FIG.3)
(FIG.3)
(FIG.4)
-28
GND
14
13
12
23
16
25
18
27
20
22
15
24
17
26
19
28
21
WL
WS
WIL
WIS
AL
AS
AIL
AIS
GL
GS
GIL
GIS
RL
RS
ON/OFF
S2

120V AC
120V AC
CHIME
113
119
54
-28
R
G
204
205
ALARM
203
RED
206
IND. PWR. SUPPLY
(FIG.6)
110
103
104
105
106
107
108
109
111
112
116
115
118
117
114
GND
120
96
97
98
99
100
101
102
9 CONDUCTORS OF 8 PR. CABLE
(FIG.3)
2

(FIG. 3)
(FIG. 4)
(FIG. 7)
(FIG. 9)
(FIG. 10)
FF5
FF6
FF13
FF16
FF17
FF4
FF12
+12
+12L
12RTN
80
81
73
74
136
137
153
154
134
135
151
152
179
180
181
182
208
172
166
161
164
159
165
170
143
168
167
163
173
171
46
144
45

(FIG.3)
84
(FIG.7)
130
OSCILLATOR (2Hz)
129
+12
77
FF20
J
S
C
K
R
Q
-Q
(FIG.3)
85
127
+12L
12RTN
(FIG.4)
+12
188
190
189
197
(FIG.9)
202
195
FF21
FF22
+12
191
193
192
196
194
CHIME MONOSTABLE MV
125
126
124
123'
123
122'
122
146
145
(FIG.9)
49
(FIG.3)
121
142
143
144
(FIG.7)
(FIG.8)

RAPCON-CONTROL TOWER COORDINATION SYSTEM

The invention described herein may be manufactured and used by or for the Government of the United States for all governmental purposes without the payment of any royalty.

The invention relates to communication systems, and particularly to a system through which the RAPCON (radar approach control) facility at an airport may visually, through color coded lights, convey to the local control tower the status of aircraft approaches under control of the RAPCON.

The inputs and outputs of the system occur at a plurality of similar key/lamp modules located at the RAPCON and in the control tower. Each module has a primary row of three illuminated keys (normally open pushbutton switches) color coded to indicate three approach zones, namely: white, farthest from touchdown; amber, intermediate; and green, nearest to touchdown. There is also provided a secondary row of three illuminated keys, situated opposite the keys of the primary row and similarly color coded, to be used if more than one aircraft is approaching the runway within the same approach zone. In this case the primary lamp represents the lead aircraft in the zone. In addition, a seventh illuminated key, color coded red, is provided in the primary row adjacent to the green key to indicate an emergency or abnormal approach condition existing with respect to the lead green zone aircraft.

A key/lamp module is provided for each operator at the RAPCON facility, for example, five. Two modules are usually provided in the control tower. Regardless of location, all modules provide the same visual display. Along with the visual system an aural indication, in the form of a single stroke chime, is activated in the control tower each time the status of the lamps is changed by the RAPCON. A solid state logic, which receives inputs from momentary actuation of the keys of the key/lamp modules and produces outputs which effect energizations of the lamps in the key/lamp modules and the chime in the control tower, provides for the following system operation:

In normal operation, the white primary key of the key/lamp module is momentarily depressed at the RAPCON when an aircraft enters the most remote control zone. This initiates a flashing white light (120 IPM) at all RAPCON and control tower key/lamp modules. The tower operator acknowledges by depressing his primary white key which causes the white lamps to steady or become continuous at all modules. Initiation and acknowledgement of amber and green lamps are identical to that for white. As the aircraft proceeds from the white outer zone into the intermediate zone, the RAPCON operator depresses his primary amber key which starts the primary amber lamps flashing and simultaneously cancels the steady white lamps. Thus, when initiating a lamp in a closer zone the logic automatically looks back one zone and cancels the primary lamp in that zone, i.e., green cancels amber, amber cancels white.

Once an aircraft moves into the amber zone, another aircraft in the white zone may then be displayed by depressing the primary white key as before. Similarly a third aircraft may be displayed when the previous two aircraft have moved into the green and amber zones, respectively. In this way, the primary row can show three different aircraft: one in each of the green, amber, and white zones. When an aircraft in the green zone lands, the RAPCON cancels the steady primary green light representing the aircraft by redepressing the primary green key. If an approach is broken off, the RAPCON operator may cancel the white, amber, or green lamp whether they are acknowledged (steady) or not (flashing) by redepressing the appropriate key.

When two aircraft are so closely spaced on approach that they both are in the same zone, the secondary row of keys/lamps is used. For example, if an aircraft in the white zone is displayed on primary white and is followed immediately by another aircraft, the RAPCON operator depresses the secondary white key which starts the secondary white lamp flashing. The tower operator acknowledges by depressing the secondary flashing white key to steady the secondary white lamp as before. If the lead aircraft now moves into the amber zone, operation of the primary amber key causes the amber lamp to flash and cancels the primary white lamp. At this point a feature of the system providing for automatic transfer between secondary and primary rows comes into play. Under this feature, if both the primary and secondary lamps in any zone are energized and the primary lamp is cancelled for any reason, such as discontinued approach, progression to a closer zone, or landing, the secondary aircraft display is transferred immediately to the primary row with whatever status it possesses (either acknowledged or unacknowledged) and the secondary lamp is extinguished. In this manner, the lead aircraft in any zone is always displayed in the primary row. Continuing the example, since activation of the amber lamp by the RAPCON caused the primary white lamp to be extinguished, the transfer feature then causes the secondary white lamp condition to transfer to primary white and simultaneously cancels secondary white. The key/lamp modules at the RAPCON and tower now show only the primary amber and white lamps illuminated, indicating that the two aircraft are the lead aircraft in their respective zones. Proceeding further with the example, if the aircraft in the white zone arrives at the amber zone before the lead aircraft leaves the amber zone, the RAPCON operator depresses the secondary amber key which starts the secondary amber lamp flashing and simultaneously cancels the primary white lamp. Operation continues in the same manner until the two aircraft have successively reached primary green and been cancelled by the RAPCON upon landing. If required, each of the three secondary lamps may be cancelled in the same manner as the primary lamps by redepressing the appropriate secondary key at the RAPCON. Such a requirement could be generated, for example, by a discontinued approach at any secondary stage.

The tower operator can not initiate or cancel white, amber, or green; he can only acknowledge. However, the tower operator can initiate the flashing red lamp by depressing the red key to indicate an emergency condition. The RAPCON operator acknowledges by depressing his red key which changes the lamp to steady red. The RAPCON operator may also initiate a steady red lamp with going through the flashing red by depressing the red key. Regardless of the initiator, the red lamp can be cancelled only at the tower. Once a red lamp is activated, the primary green lamp is automatically cancelled indicating that the lead aircraft in green is affected by the emergency condition. Activation of a red lamp also freezes the secondary green lamp and will now allow it to transfer when primary green is cancelled. It also makes the primary green key temporarily inoperative. Neither operation of the primary green key nor green transfer can take place until the red lamp is cancelled by the tower operator.

The construction and operation of the various components of the system required to provide the above functions will be described in detail with reference to the accompanying drawings, in which FIG. 1 is a block diagram of the complete coordination system showing the distribution of apparatus between the RAPCON and the control tower;

FIG. 3 shows the principal interfacing circuits between the system logic, represented by a block, and the key/lamp modules;

FIG. 6 shows the circuit diagram of the key/lamp module as used at the control tower;

Figure 11:
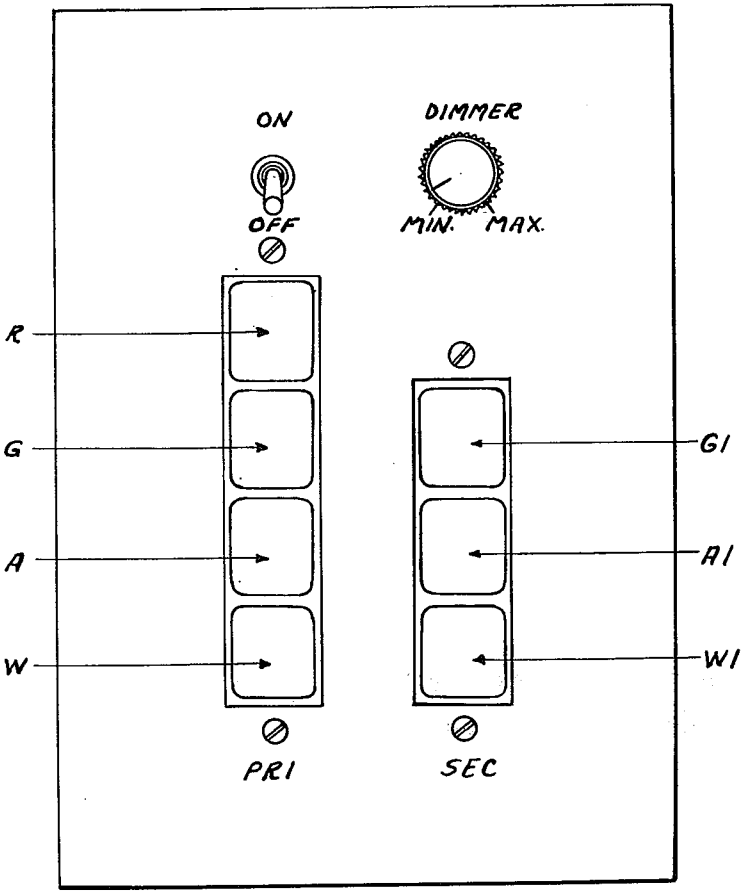

FIGS. 7 – 10 combined show the logic circuit represented by the block in FIG. 3; and FIG. 11 shows the face arrangement used on all key/lamp modules.

Figure 1:
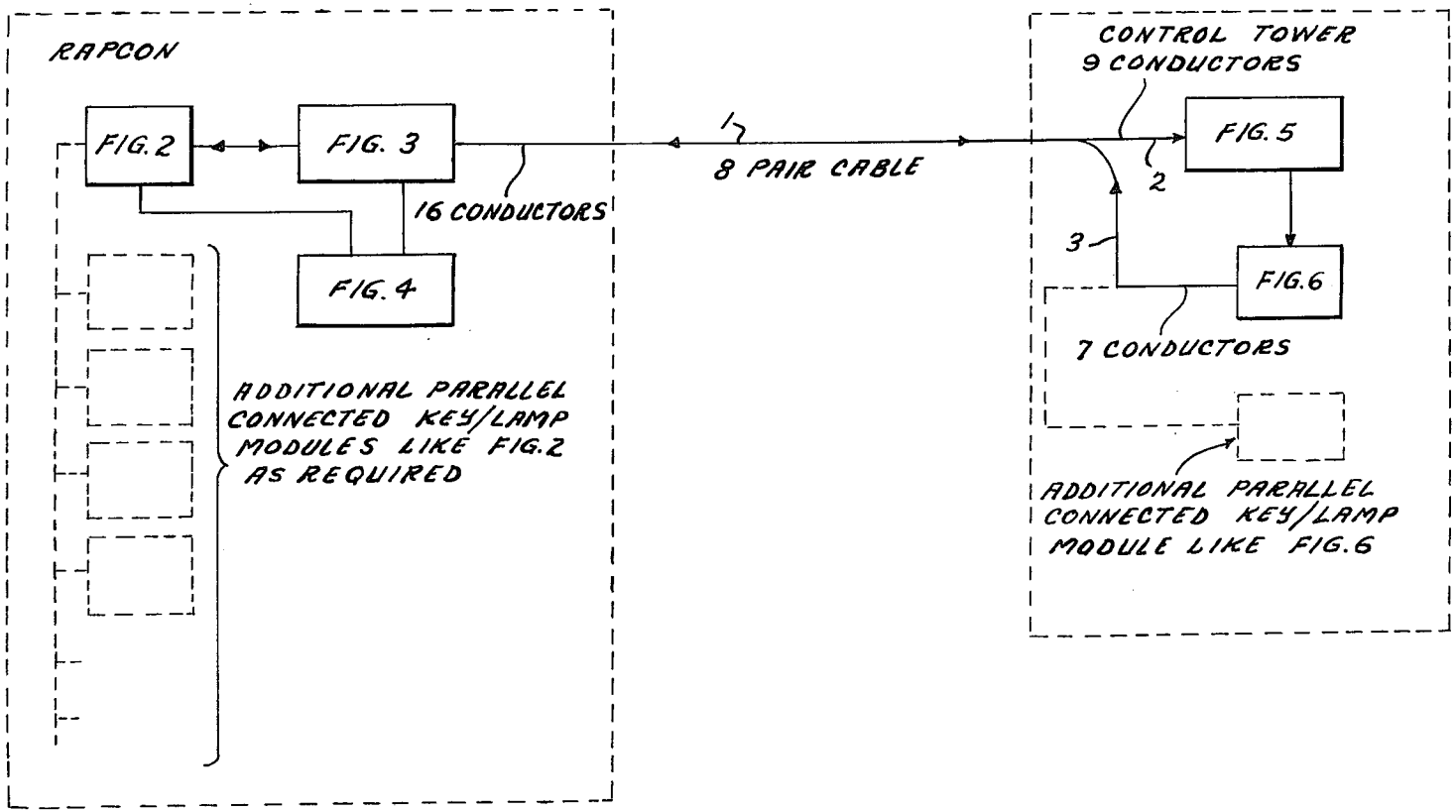
Figure 2:
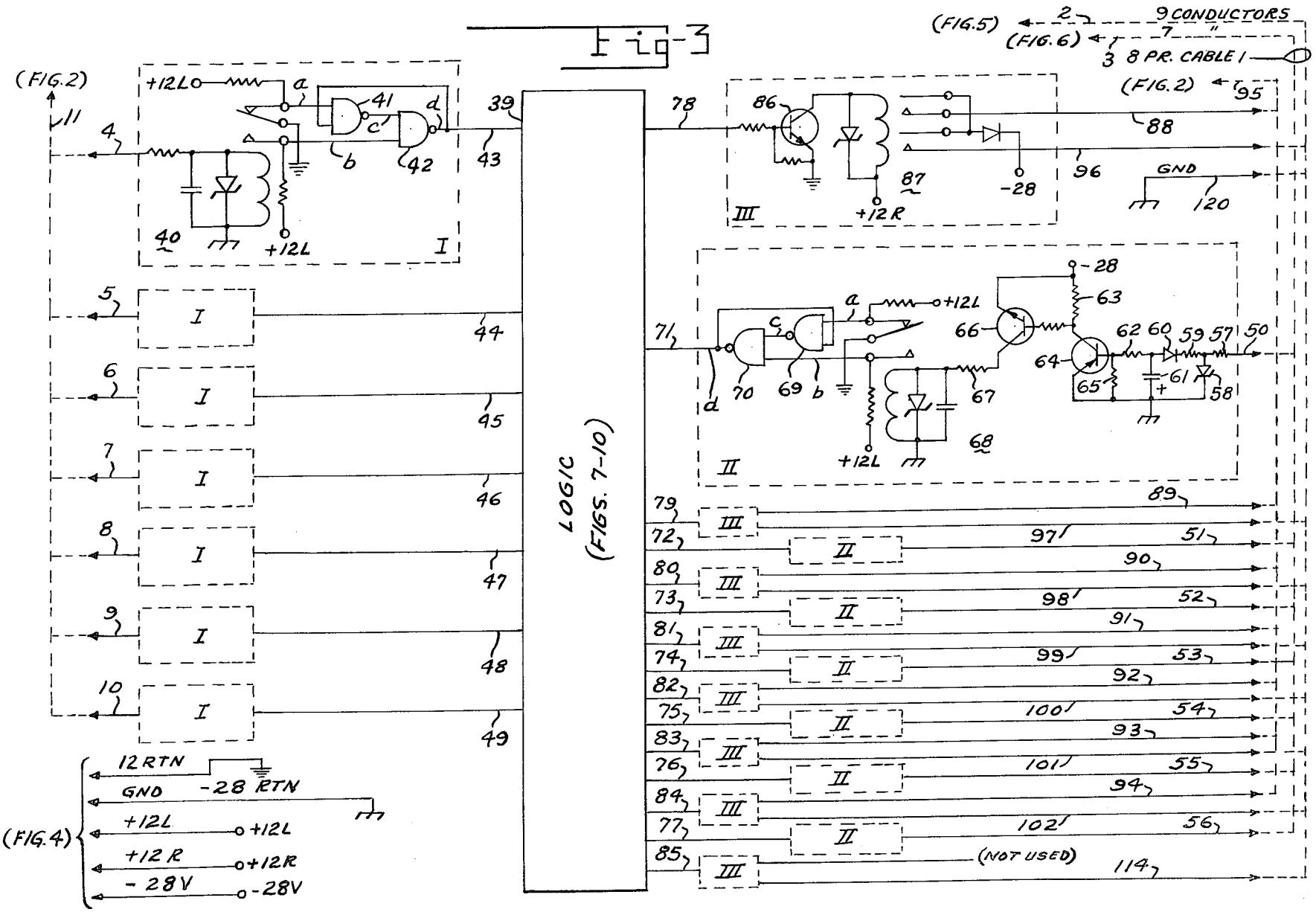
FIG. 2 is a circuit diagram of the key/lamp module as used at the RAPCON facility.
Figure 4:
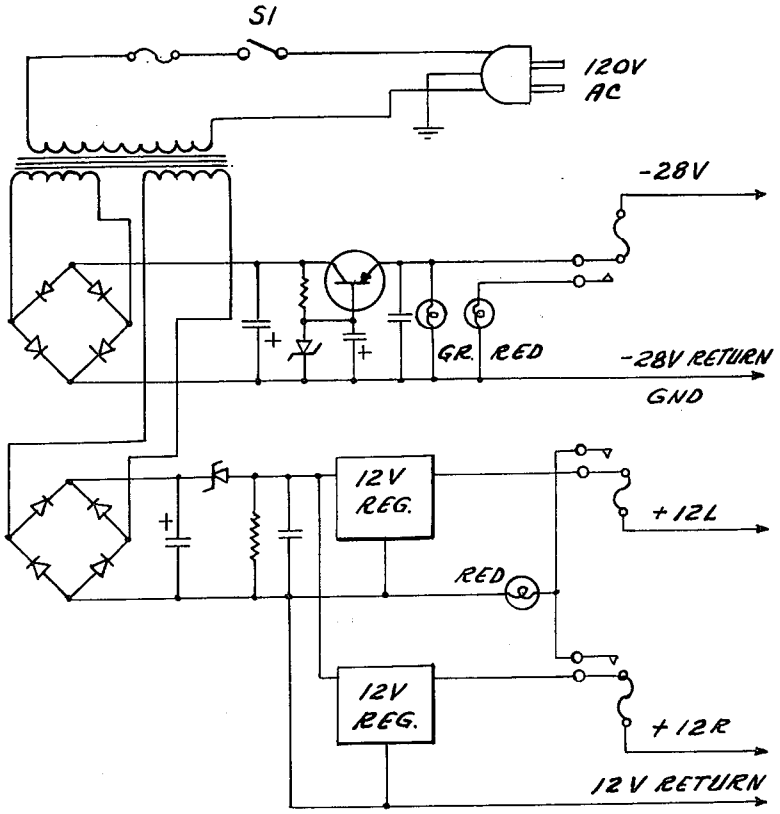
FIG. 4 shows the 12 and 28 volt power supplies for the logic, interfacing circuits, and key/lamp modules located at the RAPCON facility.

Referring to FIG. 1, which encompasses the entire system, it is seen that the equipment located at the RAPCON facility consists of a plurality of parallel connected key/lamp modules as illustrated in FIG. 2, the system logic and interfacing circuits shown in FIG. 3 (which incorporates FIGS. 7 – 10 by reference), and the power supplies shown in FIG. 4. At the control tower are located two parallel key/lamp modules as shown in FIG. 6, and all of the apparatus shown in FIG. 5. The RAPCON and control tower are interconnected by an 8 pair cable 1, all 16 conductors of which connect at the RAPCON to the apparatus in FIG. 3. At the control tower, nine of the 16 cable conductors, represented as a group by line 2, connect to the apparatus in FIG. 5, and the remaining seven of the cable conductors, represented as a group by line 3, connect to the key/lamp module represented by FIG. 6.

The key/lamp module as used in the RAPCON is shown in FIG. 2 and that used in the control tower is shown in FIG. 6. The two are identical except for the manner of controlling the key illumination, the RAPCON units regulating the background key illumination and the control tower units regulating the maximum key brightness. All modules have seven color coded illuminable keys arranged with three keys in a primary row, three keys in a similar secondary row, and one additional color coded key at the upper end of the primary row, as shown in FIG. 11. The primary keys are color coded white, amber, and green, designated W, A, and G, respectively, and the secondary keys are similarly color coded white, amber, and green, designated W1, A1, and G1, respectively. The seventh key is color coded red and designated R. In FIGS. 2 and 6, the lamps and switches associated with the W, A, G, and R keys are designated WL, WS; AL, AS; GL, GS; and RL, RS, respectively. Similarly, the lamps and switches associated with the W1, A1, and G1 keys are designated W1L, W1S; A1L, A1S; and G1L, G1S, respectively.

The RAPCON key/lamp module of FIG. 2 incorporates a dark environment circuit for regulating the background key illumination through controlling the minimum brightness of the lamps. This circuit comprises transistors 12 and 13 and control 14. The upper terminals of all lamps are connected through isolating diodes 15 – 21 and ON/OFF switch S2 to the emitter of transistor 12. These terminals are also connected through isolating diodes 22 – 28 to individual flashing circuits each of which, as will be described later, alternately closes and opens the circuit between the diode cathode and the −28 volt power supply for a flashing lamp or continuously closes this circuit for a steady lamp. Using white lamp WL as an example, with S2 closed current flows from the system ground GND, which is the positive terminal of the −28 volt power supply (FIG. 4), through the lamp to the parallel connected anodes of diodes 15 and 22. From this point there is a continuous flow of current through diode 15 and transistors 12 and 13 to the −28 volt terminal of the power supply and either a steady flow or a flow that alternates between the steady value and zero through diode 22 to the −28 volt terminal of the power supply. The total current through the lamp is the sum of the two diode currents the minimum value of which is the diode 15 current. The value of this minimum can be adjusted at potentiometer 14, which is the DIMMER control shown in FIG. 11, to control the background illumination of the keys.

Figure 5:
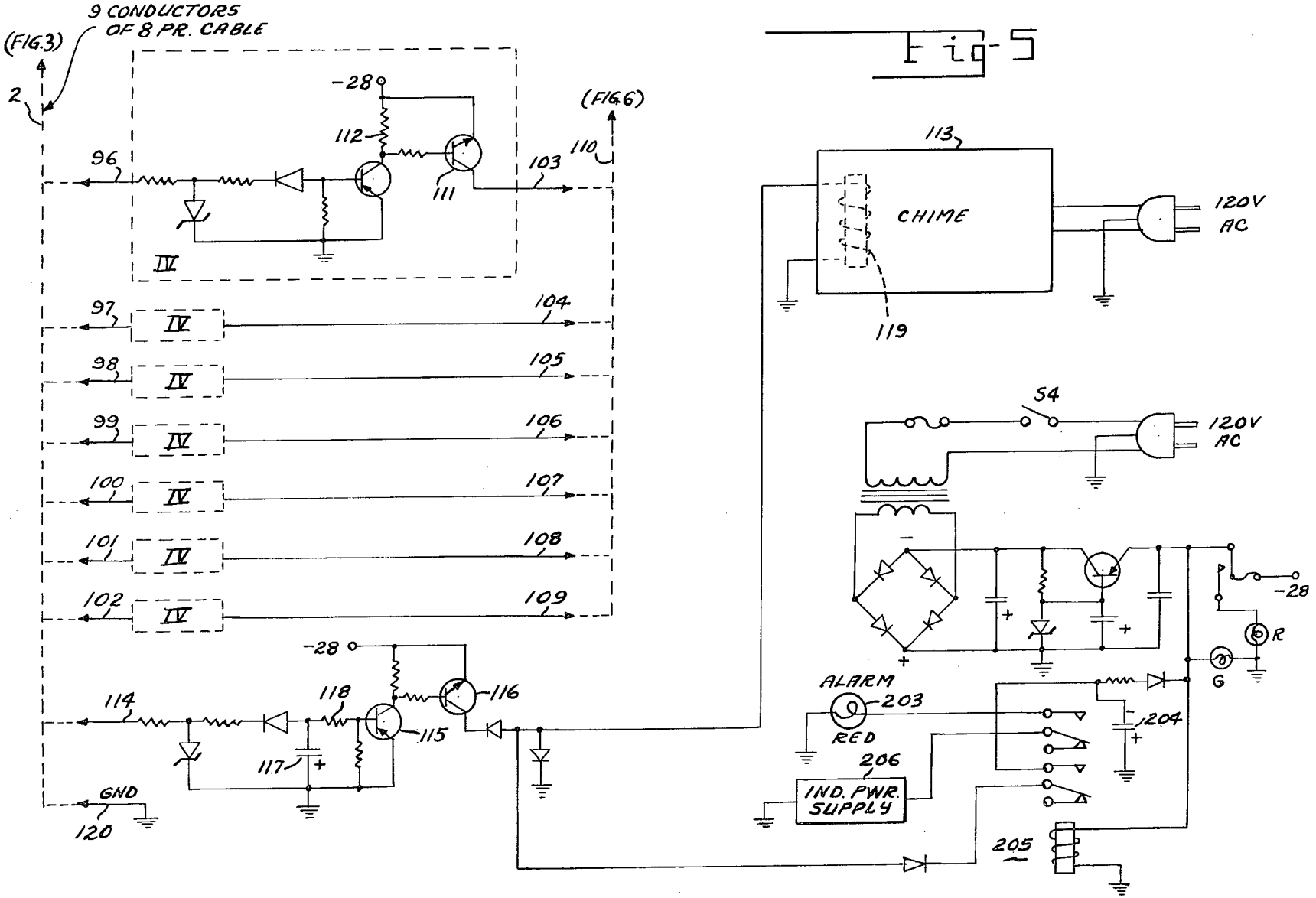
FIG. 5 shows the interfacing circuits between the incoming cable lines and the lamps of the control tower key/lamp module, the interfacing circuit between the cable and the tower chime, and the 28 volt power supply for the control tower equipment.

The tower key/lamp module (FIG. 6) uses a dimmer circuit, instead of the above described dark environment circuit, to control the maximum brightness of all lamps except the red lamp which is always at maximum brightness. This circuit comprises transistors 30 and 31 connected between the positive terminal GND of the −28 volt supply and one terminal of each primary and secondary white, amber, and green lamp. The corresponding terminal of the red lamp is connected directly to the positive terminal GND. The other terminals of all lamps are connected through diodes 32 – 38 and their individual electronic flashing switches, described later, to the negative terminal of the 28 volt power supply (FIG. 5). Adjustment of potentiometer 29, which in this case is the DIMMER of FIG. 11, controls the current flow through all lamps, other than red, and thereby controls their brightness.

The interfacing circuits between the key switches of the RAPCON key/lamp module (FIG. 2) and the system logic represented by block 29 in FIG. 3 are designated by the Roman numeral I in FIG. 3. Since all of these circuits are the same, only one, that for the primary white key switch WS in FIG. 2, is shown in detail. The circuit comprises a reed relay 40 and two NAND gates 41 and 42 connected in an R-S flip-flop configuration. The upper contact of key switch WS in FIG. 2 is connected to the ungrounded end of the relay 40 coil by conductor 4. The purpose of the R-S flip-flop is to eliminate mechanical switch contact jitter and bounce.

The operation of circuit I is given in Table I. In referring to this table, 1 is "high" and 0 is "low". NAND gates 41 and 42 each have the property that when both inputs are high (1) the output is low (0), and when either input is low (0) the output is high (1).

TABLE I

| Time Sequence | Relay Contacts | a | b | c | d |
|---|---|---|---|---|---|
| $t_1$ | upper closed | 0 | 1 | 1 | 0 |
| $t_2$ | upper breaks | 1 | 1 | 1 | 0 |
| $t_3$ | lower makes | 1 | 0 | 0 | 1 |
| $t_4$ | lower breaks | 1 | 1 | 0 | 1 |
| $t_5$ | upper makes | 0 | 1 | 1 | 0 |

Table I gives the sequence of events that occurs when the primary white key at the RAPCON key/lamp module (FIG. 2) is depressed and released, and the voltage conditions at the inputs and outputs *a*, *b*, *c*, and *d* of the two NAND gates 41 and 42 at each event. At $t_1$ the circuit is in its normal state with the output at *d*, applied to the logic 39 over conductor 43, low. Depressing the white key at $t_2$ closes switch WS and applies −28 volts over conductor 4 to the coil of relay 40 causing its upper contact to break. As seen in the table, this produces no change at output *d*, which remains low. An instant later at $t_3$, the lower relay contacts make causing *d* to go high, as seen in the table. When the white key is released at $t_4$, opening WS, the relay is deenergized and its lower contact breaks. This produces no change at the output *d*, which remains high. An instant later at $t_5$, the upper contact makes, causing *d* to go low as shown in the table. Therefore, depressing and releasing the primary white key in FIG. 2 applies a voltage pulse over line 43 to the logic 39 having its leading edge at $t_3$ and its trailing edge at $t_5$. Since, as seen at $t_4$ and $t_2$ in the table, breaking of the lower and upper contacts of the relay produces no change at *d*, bounce at the relay contacts has no effect on the output pulse.

The interfacing circuits between the remaining keys of the RAPCON module and the logic 39 are identical in construction and operation to that described above for the primary white key, the relay energizations being applied over conductors 5 – 10 and the output pulses being applied to the logic 39 over conductors 44 – 49.

The interfacing circuits between the key switches in the control tower key/lamp module (FIG. 6) and the system logic 39 in FIG. 3 are designated by the Roman numeral II. Since all of these circuits are the same, only that for the primary white key switch WS in FIG. 6 is shown in detail. Closure of switch WS in the tower module (FIG. 6) applies −28 volts over conductor 50, which is one of the seven group 3 conductors extending through cable 1 to the RAPCON, to circuit II in FIG. 3. The front end of this circuit provides input termination for the control lines from the tower and protection against short relatively high voltage transients such as might be induced by lightning. Resistor 57 and zener diode 58 provide avalanche breakdown protection from pulses with magnitude greater than −33 volts or +0.6 volts relative to ground. Resistor 59, diode 60, capacitor 61, resistor 62, resistor 63, and transistor 64 constitute an R-C circuit with time constant such as to discriminate against pulses of −28 volts or higher whose duration is less than approximately 0.1 second. Resistor 65 acts as a "pull-down" resistor to insure that transistor 64 is cut off when no voltages are present on the input. Transistor 66 and resistor 67 act together as an electronic switch to provide the current necessary to operate reed relay 68 whenever transistor 64 saturates upon a legitimate input signal being received from the key switch in the tower module. The remainder of circuit II starting with relay 68 and including NAND gates 69 and 70 is identical in construction and operation to circuit I which has already been explained in connection with Table I. The overall effect of the described circuit II is to apply a rectangular positive voltage pulse over conductor 71 to logic circuit 39 in response to depression and release of the primary white key switch in the control tower key/lamp module. The remaining six circuits II operate in the same manner, being connected to the remaining six key switches in the control tower module (FIG. 6) over conductors 51–56, the remaining six of the seven group 3 conductors, and to the logic circuit 39 over conductors 72–77.

The energizations of the lamps in both the RAPCON key/lamp module (FIG. 2) and the control tower key/lamp module (FIG. 6), and the energization of the control tower chime, are controlled through the circuits designated by Roman numeral III in FIG. 3. Since all of these circuits are alike, only one, that used to control the primary white lamp WL in each module, is shown in detail. This circuit receives the low level drive from logic 39 over conductor 78 and amplifies this signal by means of transistor 86 to a level sufficient to operate 12 volt relay 87. The logic drive is either pulsing or steady, as will be seen later, depending upon whether a steady or flashing lamp condition is required. Closure of the upper contacts of the relay applies −28 volts over conductor 88 in harness 95 to lamp WL of the RAPCON module (FIG. 2) energizing the lamp. Similarly, the remaining six lamps of the RAPCON modules are controlled by six of the remaining circuits III which connect to these lamps via conductors 89–94 and receive logic drive over conductors 79–84. Closure of the lower contacts of relay 87 applies −28 volts over conductor 96, which is one of the nine group 2 conductors in cable 1, to the input of the uppermost of the control tower circuits designated by the Roman numeral IV in FIG. 5. The output of this circuit is connected over conductor 103 in harness 110 to lamp WL of the tower module (FIG. 6), which places this lamp in the collector circuit of transistor 111. The circuit IV operates like the front end portion of circuit II (FIG. 3), already described, to provide input line termination and transient protection, but without pulse width discrimination. Transistor 111 acts as an electronic switch to turn lamp WL on or off. With no voltage on line 96, transistor 112 is nonconductive placing both the base and emitter of transistor 111 at the same potential so that this transistor presents an open circuit to lamp WL and the lamp is off. The −28 volts on conductor 96 resulting from closure of the lower contacts of relay 87 in circuit III (FIG. 3) causes transistor 112 to become fully conductive. This raises the base potential of transistor 111 relative to its emitter and reduces the collector-emitter impedance to substantially zero so that this transistor acts as a closed switch between the lamp and the negative terminal of the −28 volt power supply and causes the lamp to be energized. In the same manner, the remaining six circuits IV in FIG. 5 control the remaining six lamps of the control tower module, being connected over conductors 97–102 in conductor group 2 to the circuits III of FIG. 3 and over conductors 104–109 in harness 110 to the module lamps.

The remaining circuit III of FIG. 3, which receives its input from the logic 39 over conductor 85, is used to control the chime 113 located in the control tower and shown in FIG. 5. The upper relay contacts in this particular circuit III are not used. The lower contacts are connected over conductor 114, one of the group 2 conductors, to an interfacing circuit in the control tower comprising transistors 115 and 116. This circuit is the same as circuit IV of FIG. 5 with the pulse width discrimination feature of circuit II (FIG. 3) added (capacitor 117 and resistor 118) to prevent unintentional actuation of the chime by a short duration transient. The logic drive applied to circuit III over conductor 85 is in the form of a positive pulse of relatively short duration (0.1 to 1 second), as will be seen later, which causes the lower contacts of the circuit III relay to apply a −28 volt pulse of the same duration to conductor 114. This causes switching transistor 116 to become conductive for the duration of the pulse energizing the actuating magnet 119 of the chime. The chime is preferably a one-stroke xylophone unit.

The final conductor 120 of the nine conductor group 2 in FIG. 3 connects the positive terminal of the −28V power supply in the RAPCON, shown in FIG. 4, to the positive terminal of the −28V power supply at the control tower, shown in FIG. 5. This conductor also designated GND, serves as the system ground and the −28V return.

The logic represented by block 39 in FIG. 3 receives fourteen possible inputs on conductors 43–49 and 71–77 in the form of positive-going pulses, generated in the manner already described, and produces eight possible outputs on conductors 78–85 in the form of positive-going pulses which effect the energization of the lamps of all key/lamp modules and the energization of the chime at the control tower, in the manner already described. The details of the logic 39 are shown in combined FIGS. 7–10. The circuit is made up essentially of bistable circuits or flip-flops (FF) and logical gates which may be of any design capable of providing the required logical functions. In the specific embodiment shown, J–K flip flops are employed of which FF1 (FIG. 7) is an example. The J and K terminals are maintained high at all times by connection to the +12L terminal of the power supply in FIG. 4. The FF has two stable states: the set state in which output Q is high and output $\overline{Q}$ is low, and the reset state in which output Q is low and output $\overline{Q}$ is high. If in the set state, a pulse at terminal R will place the FF in the reset state; and if in the reset state, a pulse at terminal S will place the FF in the set state. Finally, in either state, a pulse at terminal C will "toggle" the FF to the other state. To simplify the drawing, only the signal paths are shown in FIGS. 7–10. Normally, the logical elements shown individually in the drawings would be incorporated in a number of multielement integrated circuits on each of which the manufacturer would provide the required power supply ($V_{DD}$) and ground return terminals. Conventionally, these terminals would be connected to the +12L and 12V RTN terminals of the 12 volt supply in FIG. 4. The following explains the operation of the logic 39 for each function it performs:

The request/acknowledge function involves the initiation of a flashing light at the key/lamp modules by depressing one of the keys at a RAPCON module, and the acknowledgment of this at the control tower by depressing the corresponding key at the control tower module. For example, if the RAPCON operator depresses and releases the primary white key momentarily closing switch WS (FIG. 2), a positive pulse is produced on line 43 (FIG. 3) in the manner already explained. This pulse is applied to terminal C of FF1 in FIG. 7 and also over line 121 to NOR gate 122 in FIG. 10. The pulse on line 121 passes through gate 122, inverting amplifier 123, and OR gate 124, to the trigger input of monostable multivibrator 125, triggering one cycle of operation of the multivibrator. This produces a single positive pulse at the output of the MV, of 0.1 to 1 second duration depending upon the setting of potentiometer 126, which is coupled through buffer amplifier 127 and conductor 85 to the chime circuit III in FIG. 3 to produce one stroke of the chime in the control tower in the manner already explained.

With FF1 in the reset state, the positive pulse on terminal C toggles this flip flop to the set state in which the Q output is high. This opens AND gate 128 to the output of 2 Hz oscillator 129, in FIG. 10, which is coupled via conductor 130, OR gate 131, AND gate 128, buffer amplifier 231, and conductor 78 to the input of primary white circuit III in FIG. 3. This causes relay 87 to make and break at a frequency of 2 Hz and the primary white lamp WL at all modules to flash at this frequency in the manner already explained.

Figure 7:
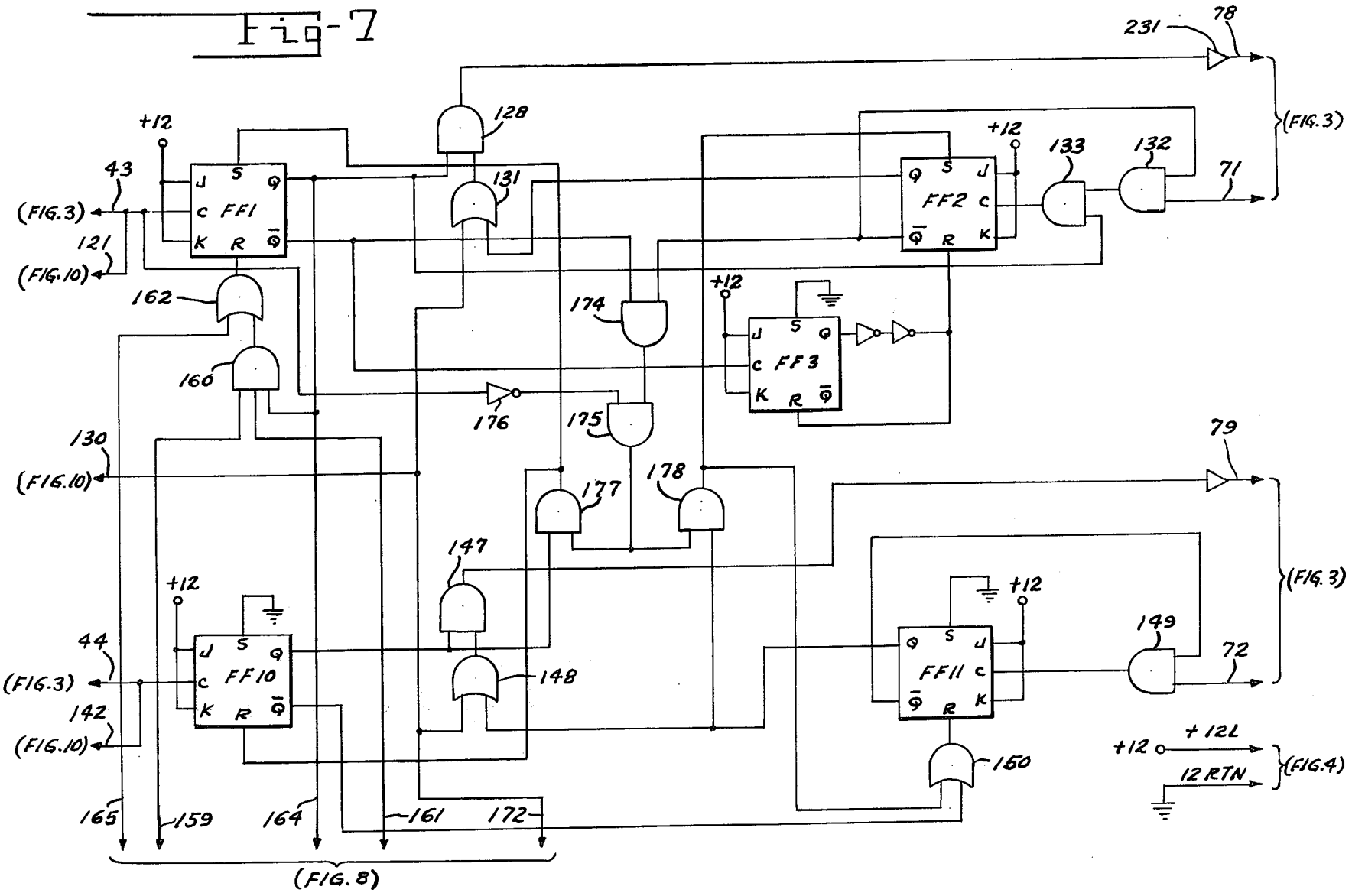

The operator at the control tower acknowledges the flashing primary white lamp by momentarily depressing the flashing key W (FIG. 11), which momentarily closes switch WS of the control tower module (FIG. 6). This operates to produce a positive pulse on line 71 (FIGS. 3 and 7) in the manner already explained. Referring to FIG. 7, with FF2 in the reset state AND gate 132 is open to the pulse on line 71. Also, with FF1 in the set state, AND gate 133 is open to the output of gate 132. Therefore, the pulse on line 71 reaches the C input of FF2 and toggles this circuit to the set state. This applies a steady high to the second input of OR gate 131, steadying the output of this gate, the output of gate 128, and the relay 87 energizing voltage on line 78 (FIG. 3). With constant rather than intermittent energization of the relay, the WL lamps in all modules change from flashing to steady. The low $\overline{Q}$ output of FF2 closes gate 132 so that the tower operator can not cancel this condition.

Figure 8:
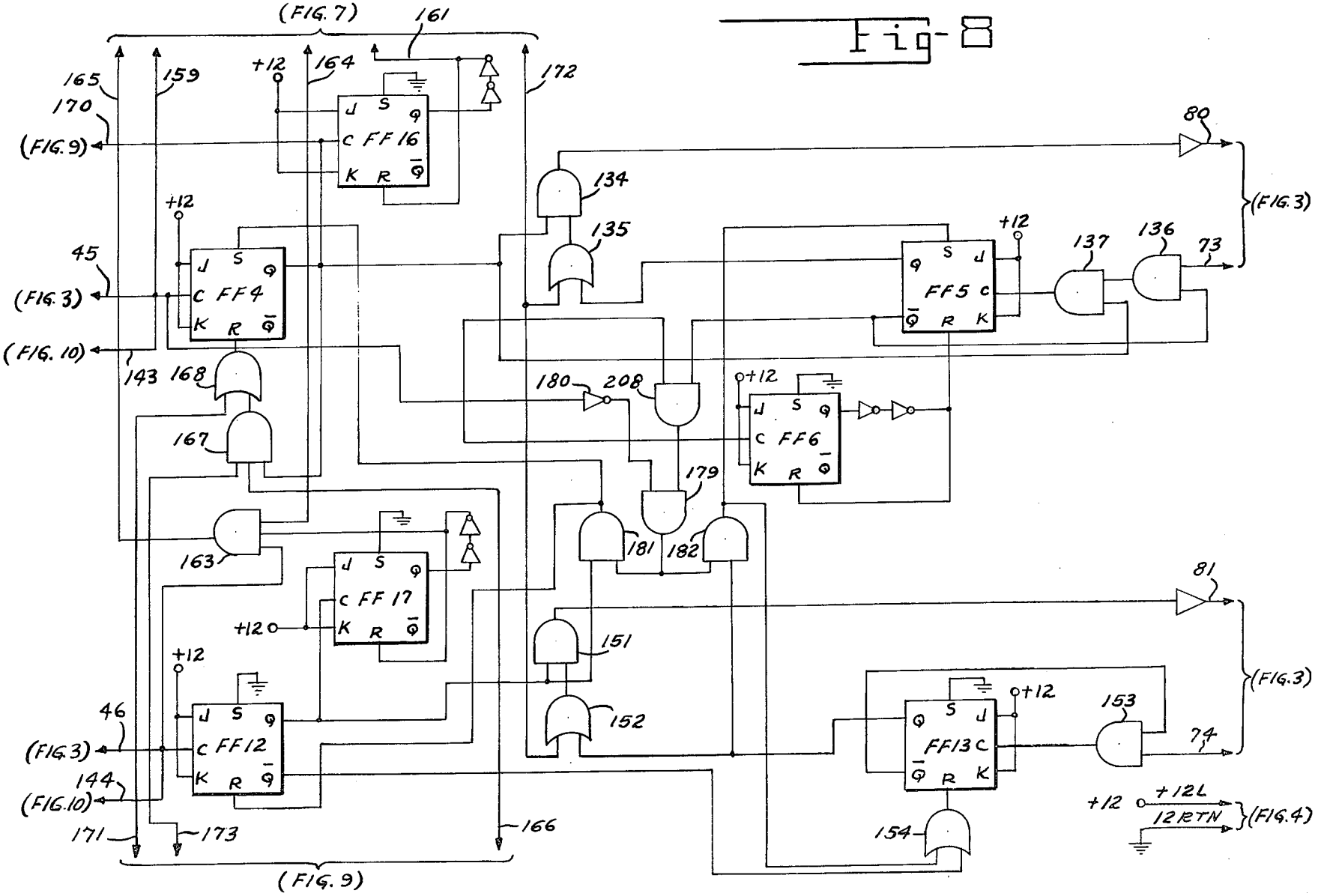
Figure 9:
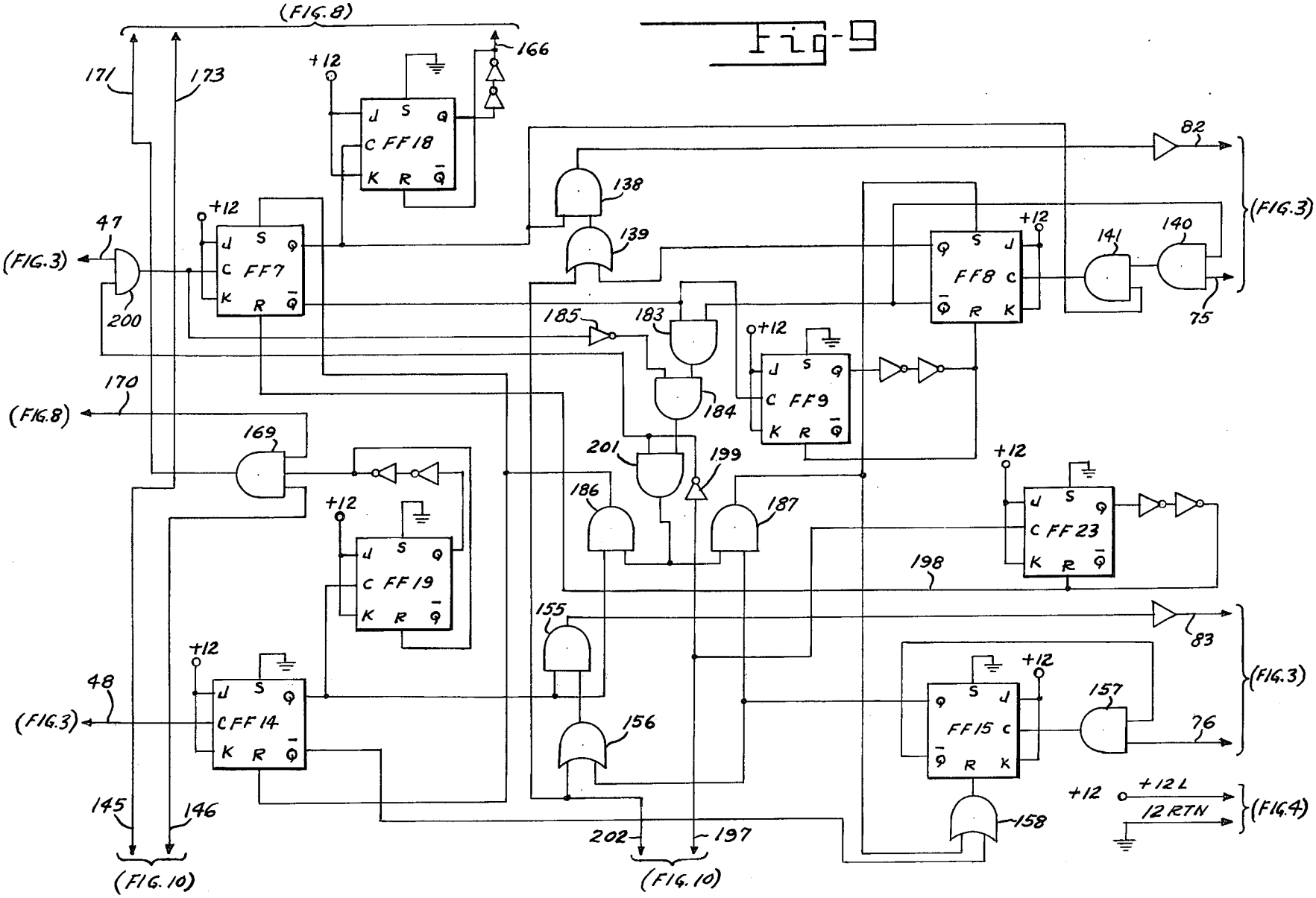
Figure 10:
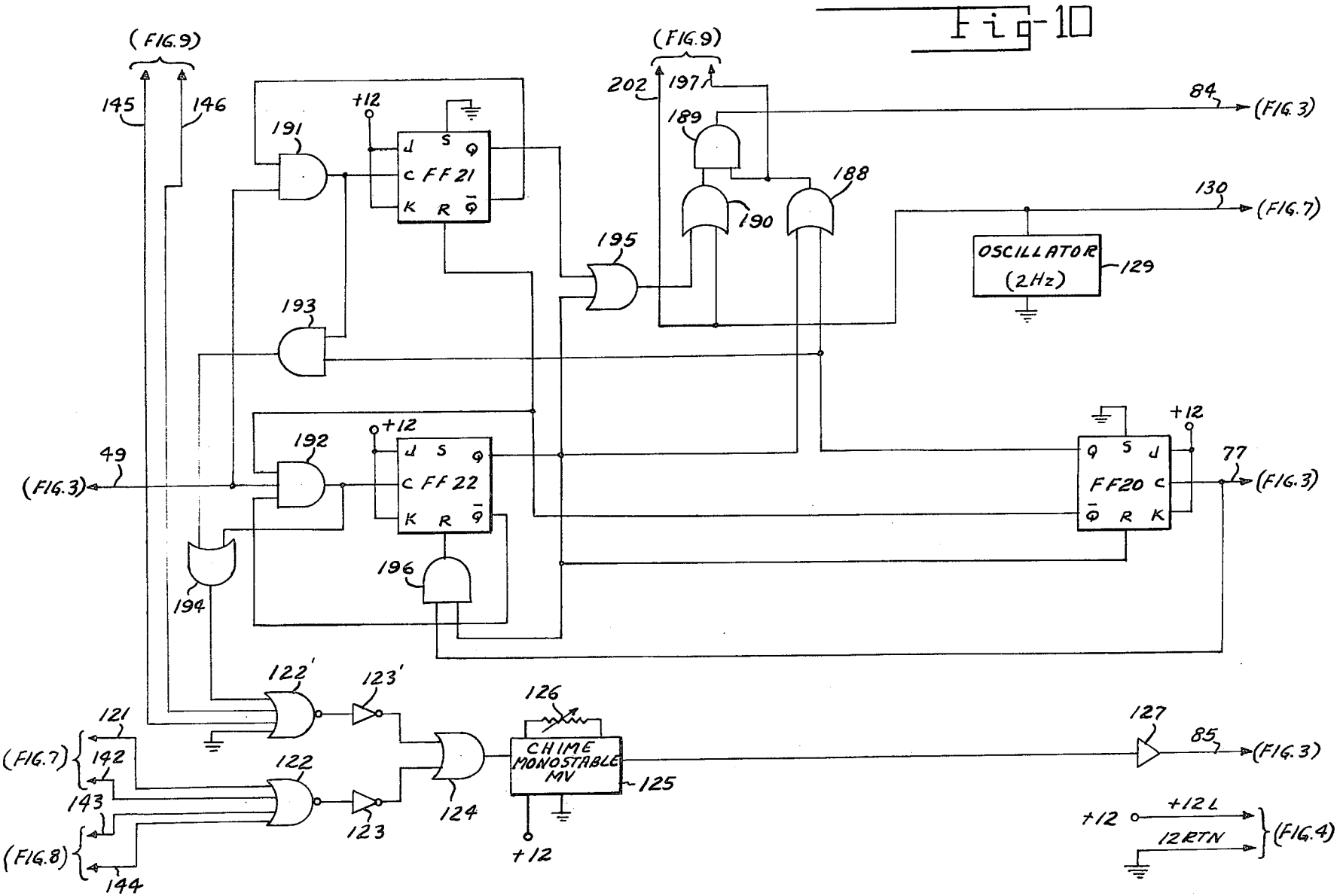

The request/acknowledge operation for primary amber and green is identical to that given above for white. The circuit components involved for primary amber are shown in FIG. 8 and are FF4–FF5, logic inputs 45 and 73, logic output 80, and gates 134–137. The primary green components are in FIG. 9 and are FF7–FF8, logic inputs 47 and 75, logic output 82, and gates 138–141. The operation for the secondary lamps is basically the same as that for primary white except that no gate corresponding to AND gate 133 is used. The circuit components involved are shown in FIGS. 7, 8, and 9 and are: secondary white: FF10–FF11, logic inputs 44 and 72, logic output 79, and gates 147–149; secondary amber: FF12–FF13, logic inputs 46 and 74, logic output 81, and gates 151–153; and secondary green: FF14–FF15, logic inputs 48 and 76, logic output 83, and gates 155–157. As for primary white, each activation of secondary white or any of the remaining amber or green primary or secondary lamp circuits causes a high to be applied over conductor 142, 143, 144, 145 or 146 to either NOR gate 122 or NOR gate 122′ (FIG. 10) to activate the tower chime in the manner already explained for primary white.

The cancellation/reset function of the logic permits the RAPCON operator to cancel a primary or secondary lamp by redepressing the key by which he initially turned the lamp on. It also provides for automatically cancelling the primary lamp of a zone when the lead aircraft in that zone passes into the next closer zone either as the lead or second aircraft in the closer zone.

To explain the operator cancellation, assume the primary lamp WL to be on, either flashing or steady, as the result of an earlier depression of the primary white key. In this circumstance, FF1 would be in its set state and FF2 in either its reset (lamp flashing) or set (lamp steady) state depending upon whether acknowledgment had been received at FF2 from the control tower. Redepressing the primary white key toggles FF1 back to its reset state and closes gate 128. Closing gate 128 removes the high on line 78, deenergizing relay 87 and extinguishes the primary white lamps as the RAPCON and control tower modules. Also, the high on the $\overline{Q}$ output of FF1 triggers the monostable or one-shot circuit incorporating FF3 to go through one cycle of operation and produce a short duration pulse on the R terminal of FF2. This resets FF2 if in its set state (acknowledged); if not, FF2 remains in its reset state. Therefore, at the end of the cancellation process, FF1 and FF2 are in their normal reset states.

Operator cancellation for primary amber and green is identical to that explained above for primary white. For the secondary lamps, the operation is essentially the same as for the primary lamps except that a monostable circuit, such as those containing FF3, FF6, and FF9 in the primary circuits, is not interposed between the $\overline{Q}$ output of the first or "request" FF and the R terminal of the second or "acknowledge" FF. Thus, in the case of secondary white, for example, the $\overline{Q}$ high when FF10 is reset is applied directly through OR gate 150 to the R terminal of FF11 to reset this flip-flop. The same is true for secondary amber and green, where the OR gates are 154 and 158, respectively.

With respect to the automatic cancellation feature, whenever the primary key for the amber or green zone is depressed to denote the entry of an aircraft from the white or amber zone, the logic looks back one zone and extinguishes the primary lamp in that zone. Assume, for example, that the lead aircraft in the white zone, represented by the illuminated primary white key, passes into the amber zone. The RAPCON operator depresses the primary or the secondary amber key, the latter when the zone is already occupied by an aircraft. Considering the primary case first, depressing the primary amber key produces a positive pulse on logic input 45 (FIG. 8) which toggles FF4 to the set state and starts the primary amber lamp in each module flashing in the manner already explained. The positive pulse on line 45 is also applied over conductor 159 to the left hand input of AND gate 160 (FIG. 7), the right hand input of which is already high due to its connection to the Q output of FF1. Toggling FF4 to its set state causes its Q output to go high which triggers one cycle of operation of the monostable circuit incorporating FF16, producing in the process a short positive pulse on conductor 161 which is applied to the third input of AND gate 160 (FIG. 7). Since the other two inputs are high, the pulse passes through gate 160 and OR gate 162 to the R terminal of FF1. This resets FF1 extinguishing the primary white lamps WL by closing gate 128 in the manner already explained. For the secondary case, depressing the secondary amber key puts a positive pulse on logic input 46 (FIG. 8) which toggles FF12 to its set state causing the secondary amber lamps to flash. At the same time, the monostable circuit of FF17 is triggered and produces a short pulse on the center input of AND gate 163 which, because its other two inputs are now high by virtue of one being connected to conductor 46 and the other being connected by conductor 164 to the Q output of FF1 (FIG. 7), passes the pulse via conductor 165 and OR gate 162 (FIG. 7) to the R terminal of FF1, resetting FF1 and cancelling the primary white lamps WL by closing gate 128.

The operation when the lead aircraft in the amber zone passes into the green zone is identical to that described above for white-amber. For primary entry, toggling FF7 (FIG. 9) to the set state to turn on the primary green lamp, triggers the FF18 monostable circuit to apply a pulse over conductor 166 to the center input of open AND gate 167 (FIG. 8) and thence through OR gate 168 to the R terminal of FF4, which resets FF4 and cancels the primary amber lamp. For secondary entry, toggling FF14 (FIG. 9) to the set state to turn on the secondary green lamp, triggers the FF19 monostable circuit to apply a pulse to the center input of open AND gate 169 and thence over conductor 171 and through OR gate 168 (FIG. 8) to the R terminal of FF4, which resets this flip-flop and cancels the primary amber lamp.

It should be noted with respect to the above described cancellation/reset function, that a reset pulse for one zone back is generated only when the request FF, either primary or secondary, is toggled from the reset to the set state, i.e., when its Q output goes from low to high. This results from the fact that the monostable circuits which generate the reset pulse, such as that containing FF16 for primary amber, are triggered when their C terminal goes from low to high but not when it goes from high to low. For example, assume both primary white and primary amber to be on, indicating a controlled aircraft in each zone, and the primary amber aircraft enters the green zone. Depression of the primary or secondary green key cancels primary amber by automatically resetting FF4. This does not cancel primary white since the monostable circuit of FF16 is not triggered by the resetting of FF4. For the same reason, primary white would not be cancelled if the operator should cancel primary amber by redepressing the primary amber key, such as might occur if the approach of the lead amber craft were discontinued.

The transfer function of the logic provides for automatically transferring the secondary lamp condition to the primary lamp of the same zone when the primary lamp is cancelled either by the operator or by a reset pulse from the next closer zone through the reset process described above. Also, it provides for automatically activating the primary lamp rather than the secondary lamp in the case where the secondary key is inadvertently actuated with the primary lamp off.

Considering first the automatic transfer of the secondary lamp condition to the primary lamp upon cancellation of the primary lamp, assume both primary and secondary white to be on and steady. Under this condition FF1, FF2, FF10, and FF11 are in their set states with their Q outputs high and their $\overline{Q}$ outputs low. Assume now that FF1 is reset by a reset pulse on its R terminal, such as would occur if the primary or secondary amber key were depressed to denote entry of the primary white craft into the amber zone. Resetting of FF1 causes resetting of FF2, in the manner already explained, causing both $\overline{Q}$ outputs to go high and a high to appear at the output of AND gate 174. This also produces a high at the output of AND gate 175 which is open due to the high on its left hand input resulting from the inversion, by inverting buffer 176, of the low on conductor 43 (switch WS in FIG. 2 open). The high at the gate 175 output opens AND gates 177 and 178, which passes the high on the Q output of FF10 and the high on the Q output of FF11 to the S terminal of FF1 and the S terminal of FF2, respectively, resetting these flip-flops and turning primary white lamp WL steady on. At the same time, the outputs of gates 177 and 178 are applied to the R terminal of FF10 and the R terminal of FF11, respectively, resetting these flip-flops and turning the secondary white lamp W1L off. The steady secondary white lamp W1L has now been transferred to steady primary white WL and the secondary lamp extinguished. As soon as either FF1 or FF2 is set, the output of gate 174 is low and the transfer pulses at the outputs of gates 177 and 178 are removed from the system. If, in the initial conditions, secondary white W1L had been flashing, rather than steady, FF11 would have been in its reset state. In this state its Q output is low and gate 178 is closed so that no set pulse is applied through this gate to FF2. With FF1 set and FF2 reset, primary white WL is flashing. Therefore, the flashing state of the secondary lamp is preserved when it is transferred to primary status.

To explain the operation when a secondary key is inadvertently actuated to denote entry of an aircraft into an unoccupied zone, assume the white zone to be unoccupied (FF1, FF2, FF10, and FF11 in their reset states and WL and W1L off). Actuation of the white secondary key momentarily closes W1S (FIG. 2) and places a positive pulse on conductor 44 (FIG. 7) in the manner already explained. This toggles FF10 to its set state causing a high on its Q output which is transmitted through AND gate 177 to the S terminal of FF1 setting this flip-flop and causing the primary white lamp WL to flash in the manner already explained. Gate 177 is open to permit this because the output of AND gate 175 is high as the result of its two inputs being high, that from gate 174 because FF1 and FF2 are in the reset state and that from inverting buffer 176 because conductor 43 is low. At the same time, the output from gate 177 is applied to the R terminal of FF10 so that this flip-flop is immediately reset preventing energization of the secondary white lamp W1L. Therefore, inadvertent actuation of the secondary key with the primary lamp off operates to energize the primary lamp just as if the operator had actuated the primary key as he should have done.

The transfer operations for amber and green are identical to that described above for white except that provision is made for preventing primary green activation and secondary green to primary green transfer when the red lamp is activated. How this is accomplished will be explained in connection with the description of red lamp operation. The elements involved in the transfer operations of amber and green are: amber: FF4, FF5, FF12, FF13, 179–182, and 208; and for green: FF7, FF8, FF14, FF15, and 183–187.

The red lamp may be initiated either at the tower or the RAPCON, but can be cancelled only at the tower. At the tower, activation of the red key causes a flashing red light which must be acknowledged by the RAPCON. When initiated at the RAPCON, the intermediate flashing state does not occur. Once the red lamp is activated the primary green lamp is cancelled indicating that the lead aircraft in green is affected by the emergency condition. Neither activation of primary green nor transfer of secondary green to primary green can take place until the red lamp has been cancelled by the tower operator. The operation of the logic is as follows:

To activate the red lamp at the control tower, the control tower operator momentarily depresses the red key of the key/lamp module (FIG. 6), which momentarily closes switch RS and produces a positive pulse on logic input conductor 77 (FIGS. 3 and 10) in the manner already explained. This toggles FF20 to the set state producing a high at its Q output which is transmitted through OR gate 188 to AND gate 189 opening this gate and permitting the 2Hz flashing signal, received via OR gate 190 from oscillator 129, to be sent over conductor 84 (FIG. 3) to flash the red lamps in the RAPCON and tower modules in the manner already explained.

To acknowledge the flashing red signal, the RAPCON operator momentarily depresses the red key at the RAPCON module which momentarily closes switch RS causing a positive pulse to appear on logic input conductor 49 (FIGS. 3 and 10), in the manner already explained, and consequently on the lower input to AND gate 191 and the center input to AND gate 192. Due to the low on the $\overline{Q}$ output of FF20, gate 192 is closed; however, gate 191 is open, due to the reset state of FF21, so that the positive pulse on conductor 49 appears at the output of gate 191. From here it is applied through AND gate 193, which is open due to the high on the Q output of FF20, and through OR gate 194 to gate 122' to actuate the control tower chime in the manner already described. It also toggles FF21 to its set state with the resulting high on its Q output being applied through OR gate 195 to gate 190 to steady the output of this gate and that of gate 189, which steadies the illumination of the red lamp. The low on the $\overline{Q}$ output of FF21 closes gate 191 and prevents the red key at the RAPCON from further affecting the logic.

To cancel the steady red, the control tower operator redepresses the red key causing a second pulse to appear on conductor 77 in the same manner as the first. This toggles FF20 back to its original reset state. The resulting low on the Q output appears at the output of gate 188 and closes gate 189, extinguishing the red lamp.

A steady red lamp may be initiated at the RAPCON without going through the flashing stage in the following manner:

Momentary depression of the red key at the RAPCON module (FIG. 2) places a positive pulse on conductor 49 (FIGS. 3 and 10), in the manner already described, which appears on the lower input of gate 191 and the center input of gate 192. Although gate 191 is open, the pulse at its output accomplishes nothing since it is blocked from the chime circuit by gates 193, which is closed by the low on the Q output of FF20, and can not toggle FF21 since this flip-flop is held in its reset state by the high on its R terminal derived from the high on the $\overline{Q}$ output of FF20. The pulses on conductor 49 also appears at the output of gate 192, which is open due to the highs on the $\overline{Q}$ outputs of FF22 and FF21 in their reset states. This pulse is applied to the chime circuit through gate 194 and gate 122' to actuate the chime in the control tower, and also to terminal C of FF22 which it toggles to the set state. The resulting high on the Q output of FF22 is applied through gate 195 to gate 190 to steady its output, and through gate 188 to open gate 189. The resulting steady output on conductor 84 produces a steady illumination of the red lamps. The high on the Q output of FF22 is also applied to the R terminal of FF20 to hold this flip-flop in its reset state against actuation by a pulse on line 77, and to gate 196 to open this gate. The low on the $\overline{Q}$ output of FF22 closes gate 192 and prevents the RAPCON operator from further affecting the logic.

To cancel the steady red, the control tower momentarily depresses the red key which produces a positive pulse on conductor 77 as before. Since FF20 can not be activated as explained above, the pulse on line 77 only affects the R terminal of FF22 which it reaches through open gate 196. This resets FF22 and returns the circuit to its original state, the low on the Q output of FF22 removing the high at the output of gate 189 and extinguishing the red lamps.

The manner in which activation of the red lamp cancels primary green and prevents reactivation of primary green and transfer of secondary green to primary green until the red lamp has been cancelled, is as follows:

For either flashing or steady red lamp activation a high is produced at the output of gate 188, as explained above. This is applied via conductor 197 to the C terminal of FF23 triggering one cycle of operation of the monostable circuit of which this flip-flop is a part. The resulting short output pulse on line 198 is applied to the R terminal of FF7 resetting the flip-flop and extinguishing the green lamp. At the same time, the high on conductor 197, converted to a low by inverting buffer 199, closes AND gates 200 and 201, the former preventing activation of primary green by a pulse on conductor 47 and the latter preventing transfer of secondary green to primary green.

Cancellation of the red lamp at the control tower, in the manner already explained, removes the high from the output of gate 188 and conductor 197. This reopens gates 200 and 201 but does not affect the monostable circuit incorporating FF23 since the flip-flop does not toggle on a negative-going voltage. The reopening of gate 200 permits normal activation of primary green, and the reopening of gate 201 permits normal transfer from secondary green to primary green when primary green is cancelled. If secondary green, either steady or flashing, is on when red is cancelled, the reopening of gate 201 opens gates 186 and 187, permitting the high at the Q output of FF14, acting through gate 186, to set FF7, activating primary green, and to reset FF14, cancelling secondary green. If FF15 is in its set state at this time (secondary green steady) the high at its Q output acts through gate 187 to set FF8, making primary green steady, and to reset FF15. If FF15 is initially in its reset state (secondary green flashing), its Q output is low, leaving FF8 and FF15 in their reset states and causing primary green to flash. The condition of the secondary lamp is therefore transferred to the primary lamp, as before.

The power supply for all equipment located at the RAPCON facility is shown in FIG. 4. Both the 12V and 28V supplies are regulated. The green pilot indicates that the 28V supply is operative. The red pilots signal blown fuses.

The control tower power supply is shown in FIG. 5. The green and red pilots indicate operative condition and blown fuse, respectively. There is also provided an arrangement for lighting a red alarm lamp 203 and producing a single stroke of the chime 113 if the power fails. Describing this feature, when the power supply is operative capacitor 204 is charged to the power supply voltage and relay 205 is energized. Failure of the power supply releases relay 205 connecting alarm lamp 203 to an independent power supply 206 through the upper set of NC contacts of relay 205 and connecting the actuating coil 119 of the chime across capacitor 204 through the lower set of NC contacts of the relay. Discharge of the capacitor through coil 119 produces a single stroke of the chime. Restoration of power opens the two sets of NC contacts extinguishing lamp 203 and permitting capacitor 204 to recharge.

I claim:

1. A system for communication between the RAPCON and the control tower at an airport based on visual indications, said system comprising: a transmission link between the RAPCON and the control tower; like keyboards at the RAPCON and the control tower, each keyboard having like primary and secondary rows of three illuminable keys color coded $C_1$, $C_2$, and $C_3$, $C_2$ being the color of the central key; means responsive to the actuation of any primary or secondary key at the RAPCON to produce a flashing illumination of that key and the corresponding key at the control tower; means responsive to actuation of the said corresponding key at the control tower to steady the illumination of both keys; means operative during flashing or steady illumination of said keys to prevent cancellation of the illumination by further actuation of said corresponding key at the control tower; means responsive to the reactuation of any illuminated key at the RAPCON to cancel the illumination of that key and the corresponding key at the control tower; means responsive to actuation of a primary or secondary key of color $C_2$ at the RAPCON to cancel the illumination of the primary key of color $C_1$ at both the RAPCON and the control tower; means responsive to the actuation of the primary or secondary key of color $C_3$ at the RAPCON to cancel the illumination of the primary key of color $C_2$ at both the RAPCON and the control tower; and means responsive to cancellation of the illumination of any primary key to transfer the illumination status of the secondary key of the same color to the primary key.

2. The apparatus of claim 1 plus means responsive to actuation of a secondary key at the RAPCON, when the primary key of the same color is not illuminated, to produce a flashing illumination of the primary key of the same color at both the RAPCON and the control tower.

3. The apparatus of claim 2 plus an additional illuminable key of color $C_4$ on each of said keyboards; means responsive to actuation of the additional key at the control tower to produce a flashing illumination of the additional key at both the RAPCON and the control tower; means responsive to actuation of the additional key at both the RAPCON to produce a steady illumination of the additional key at both the RAPCON and the control tower from either the nonilluminated or the flashing state; means responsive either to the aforesaid actuation of the additional key at the control tower or the aforesaid actuation of the additional key at the RAPCON in its nonilluminated state to cancel the illumination of the primary key of color $C_3$ at both the RAPCON and the control tower; means operative during steady illumination of the additional keys to prevent cancellation of the illumination by actuation of the additional key at the RAPCON; and means responsive to actuation of the additional key at the control tower, when that key is illuminated, to cancel the illumination of the additional key at the RAPCON and the control tower.

4. The apparatus of claim 3 plus means operative when the said additional keys have either flashing or steady illumination to prevent illumination of the primary keys of color $C_3$ at the RAPCON and the control tower either by actuation of the primary key of color $C_3$ at the RAPCON or by transfer of the illumination status of the secondary keys of color $C_3$ to the primary keys.

5. The apparatus of claim 4 plus means responsive to the actuation of any key at the RAPCON to produce an audible signal at the control tower.

6. The apparatus of claim 5 in which, on each keyboard, the primary and secondary rows of three keys are in juxtaposition, and the said additional key is situated at the end of the primary row adjacent to the key of color $C_3$.

* * * * *

UNITED STATES PATENT AND TRADEMARK OFFICE

CERTIFICATE OF CORRECTION

PATENT NO. : 4,006,446

DATED : February 1, 1977

INVENTOR(S) : James K. White

It is certified that error appears in the above-identified patent and that said Letters Patent are hereby corrected as shown below:

Column 2, line 62: change "with" to --- without ---.

Column 3, line 1 : change "now" to --- not ---.

Column 4, line 53: change "29" to --- 39 ---.

Column 14, line 51: cancel "both".

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*